US010035695B2

(12) United States Patent
Rider

(10) Patent No.: US 10,035,695 B2
(45) Date of Patent: Jul. 31, 2018

(54) BUCKLE ASSEMBLY FOR A STIRRUP STRAP

(71) Applicant: Jimmy R. Rider, Minco, OK (US)

(72) Inventor: Jimmy R. Rider, Minco, OK (US)

( * ) Notice: Subject to any disclaimer, the term of this patent is extended or adjusted under 35 U.S.C. 154(b) by 24 days.

(21) Appl. No.: 14/642,403

(22) Filed: Mar. 9, 2015

(65) Prior Publication Data

US 2015/0259191 A1 Sep. 17, 2015

Related U.S. Application Data

(60) Provisional application No. 61/973,546, filed on Apr. 1, 2014, provisional application No. 61/950,975, filed on Mar. 11, 2014.

(51) Int. Cl.

| | |
|---|---|
| ***B68C 1/16*** | (2006.01) |
| ***A44B 11/22*** | (2006.01) |
| ***A44B 11/25*** | (2006.01) |

(52) U.S. Cl.

CPC ..... *B68C 1/16* (2013.01); *A44B 11/22* (2013.01); *A44B 11/2592* (2013.01); *Y10T 24/4044* (2015.01)

(58) Field of Classification Search

CPC .... B68C 1/16; B68C 1/14; B68C 3/00; B68C 1/00; B68C 2001/042; Y10T 24/4044; Y10T 24/404; Y10T 24/45241; Y10T 24/45524; Y10T 24/45529; Y10T 24/45696; A44B 11/20; A44B 11/22; A44B 11/223; A44B 11/25; A44B 11/2592

USPC ..... 54/46.1, 47, 44.3, 69; 24/163 R, 179, 24/647, 166, 168, 174, 265 EC, 336, 615, 24/656, 68 E

See application file for complete search history.

(56) References Cited

U.S. PATENT DOCUMENTS

| | | | | |
|---|---|---|---|---|
| 1,365,551 A | | 1/1921 | Settles | |
| 1,395,627 A | * | 11/1921 | Binkley | E05C 19/06 24/640 |
| 1,752,544 A | | 4/1930 | Sparrow | |
| 1,764,240 A | * | 6/1930 | Blustein | A44C 5/2042 24/606 |
| 2,192,640 A | * | 3/1940 | Fields | A44B 11/22 24/176 |

(Continued)

OTHER PUBLICATIONS

Anonymous, "Saddle/Tack Tip—Saving Your Blevins Buckle Keeper", Functional Horsemanship, Jul. 5, 2014, retrieved from http://functionalhorsemanship.blogspot.com/2014/07/saddletack-tip-saving-your-blevins.html on Nov. 10, 2017.

*Primary Examiner* — Kathleen I Alker
*Assistant Examiner* — Jeffrey R Larsen
(74) *Attorney, Agent, or Firm* — Dunlap Codding, P.C.

(57) ABSTRACT

A buckle assembly for a stirrup strap is disclosed, one aspect comprising a plate connectable to a first end of the strap, the plate having a tongue extendable from the first end of the strap, the tongue having at least one pin extending perpendicularly from the first side, the pin being insertable in a strap through-hole near a second end thereof; and a receiver having a sleeve with a first side and a second side, the sleeve being configured to slidably receive the second end of the stirrup strap and the tongue when the pin of the first side of the tongue is positioned in one of the through-holes, the receiver further having a spring latch with a distal end having an opening for receiving the pin, the spring latch moveable between a locking position and a release position.

13 Claims, 8 Drawing Sheets

(56) References Cited

U.S. PATENT DOCUMENTS

| | | | | |
|---|---|---|---|---|
| 2,634,480 | A | 4/1953 | Ray | |
| 3,096,552 | A | 7/1963 | Kreger, Jr. | |
| 3,205,637 | A | 9/1965 | Welton | |
| 3,209,423 | A | 10/1965 | Cattin | |
| 3,314,121 | A | 4/1967 | Blevins et al. | |
| 3,886,632 | A | 6/1975 | Bako | |
| 4,141,198 | A | 2/1979 | Gaertner | |
| 4,233,712 | A | 11/1980 | Horst et al. | |
| D260,307 | S | 8/1981 | Horst et al. | |
| 4,413,465 | A | 11/1983 | Blevins et al. | |
| 4,424,636 | A | 1/1984 | Everest | |
| D303,232 | S | 9/1989 | Lortz et al. | |
| 4,960,354 | A | 10/1990 | Moore | |
| 5,031,387 | A | 7/1991 | Rider | |
| 5,354,088 | A | 10/1994 | Vetter et al. | |
| 5,452,498 | A | 9/1995 | Veach | |
| D376,995 | S | 12/1996 | Veach et al. | |
| 5,732,448 | A | 3/1998 | Shields et al. | |
| 5,857,247 | A | 1/1999 | Warrick et al. | |
| 5,896,626 | A | 4/1999 | Birkenstock | |
| 6,748,727 | B1 | 6/2004 | Schulte | |
| D630,127 | S | 1/2011 | Johnson | |
| 8,424,547 | B1 | 4/2013 | Ma et al. | |
| D691,920 | S | 10/2013 | Smith | |
| 2006/0174454 | A1* | 8/2006 | Dahl ..... | A44B 11/22 24/185 |
| 2014/0075723 | A1 | 3/2014 | Iten | |
| 2015/0259191 | A1 | 9/2015 | Rider | |
| 2016/0081439 | A1 | 3/2016 | Catanese | |

* cited by examiner

BUCKLE ASSEMBLY FOR A STIRRUP STRAP

CROSS-REFERENCE TO RELATED APPLICATIONS

This application claims priority to U.S. Provisional Application Ser. No. 61/950,975, filed on Mar. 11, 2014, entitled "BUCKLE ASSEMBLY FOR A STIRRUP STRAP", and U.S. Provisional Application Ser. No. 61/973,546, filed on Apr. 1, 2014, entitled "BUCKLE ASSEMBLY FOR A STIRRUP STRAP", the entire contents of each of which are hereby expressly incorporated herein by reference.

BACKGROUND

Equestrian tack is generally adjustable to accommodate riders of different sizes. For example, the length of the stirrups are adjustable to correspond to the length of the rider's leg so that the rider may use the stirrup and corresponding stirrup strap to stabilize the rider's position in the saddle. The length of the stirrup strap is typically secured in a desired position with a buckle assembly. A problem encountered with existing buckle assemblies is that they have a tendency to release when subjected to forces created by movements of horse and rider. Failure of the buckle assembly may cause the rider to loose balance or even fall from the horse, thereby resulting in injury to the rider, and possibly the horse.

To this end, a need exists for an improved apparatus for adjusting and locking a stirrup strap of a saddle. It is to such apparatus that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations.

DETAILED DESCRIPTION OF EXEMPLARY EMBODIMENTS

Figure 1:
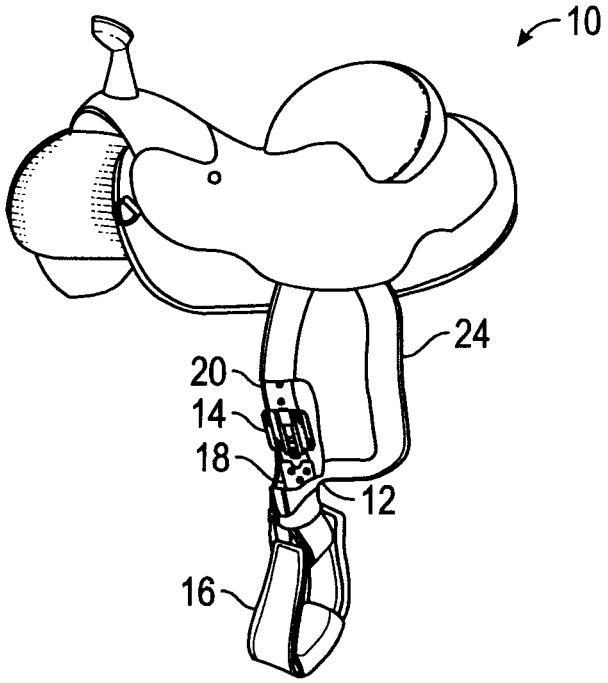
FIG. 1 is a partially cutaway, perspective view of a saddle shown with a stirrup strap secured with a buckle assembly constructed in accordance with the inventive concepts disclosed herein and shown.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
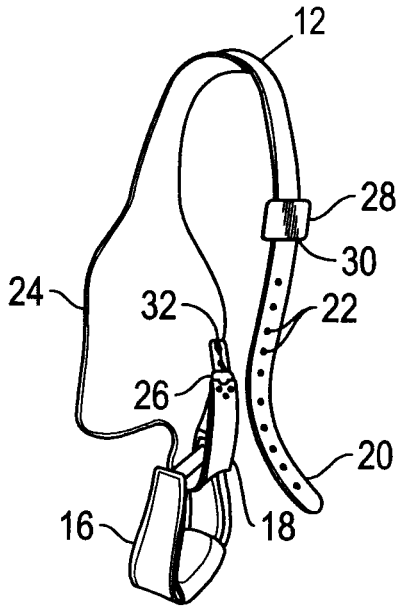
FIG. 2 is a rear perspective view of the stirrup strap of FIG. 1 shown with the buckle assembly in a release position.

Referring now to the drawings, and more particularly to FIG. 1, a saddle 10 is illustrated in conjunction with a stirrup strap 12 which is secured to the saddle 10 with a buckle assembly 14 constructed in accordance with the inventive concepts disclosed herein. The saddle 10 depicted in FIG. 1 is commonly known as a western style saddle. However, it will be understood that the buckle assembly 14 is applicable to other types of saddles and need not be limited to western style saddles. For clarity, the saddle 10 of FIG. 1 is shown in simplified form, without rigging and components typically present, showing one stirrup 16 supported by the stirrup strap 12, and with a partial cutaway of the stirrup strap 12 to more clearly illustrate the buckle assembly 14. FIG. 2 shows a rear perspective view of the stirrup strap 12 disconnected from the saddle 10.

As illustrated in FIGS. 1 and 2, the stirrup strap 12 has a first end 18 and a second end 20. The second end 20 of the stirrup strap 12 is movably attached to the saddle 10 and extends from the saddle 10. The stirrup strap 12 has a plurality of through-holes 22 extending through the stirrup strap 12 near the second end 20 of the stirrup strap 12. The second end 20 is connectable to the first end 18. The stirrup strap 12 may have a wider intermediate portion, commonly known as a fender 24, between the first end 18 and the second end 20. The stirrup strap 12 is typically made of leather, synthetic materials, and/or a combination of materials. The stirrup strap 12 may be made of one or more than one layer and/or one or more joined portions of material and may have differing thicknesses.

As illustrated in FIGS. 1-6, the buckle assembly 14 may include a plate 26 connectable to the first end 18 of the stirrup strap 12 and a receiver 28 having a sleeve 30 configured to slideably receive the second end 20 of the stirrup strap 12.

The plate 26 has a tongue 32 which extends from the first end 18 of the stirrup strap 12 when the plate 26 is connected to the stirrup strap 12. The tongue 32 has a first side 34 and a second side 36. The tongue 32 also has at least one pin 38 extending substantially perpendicularly from the first side 34 and at least one pin 40 extending substantially perpendicularly from the second side 36. The pin 38 of the first side 34 is insertable in a least one of the plurality of through-holes 22 extending through the stirrup strap 12 near the second end 20 of the stirrup strap 12.

Figure 4:
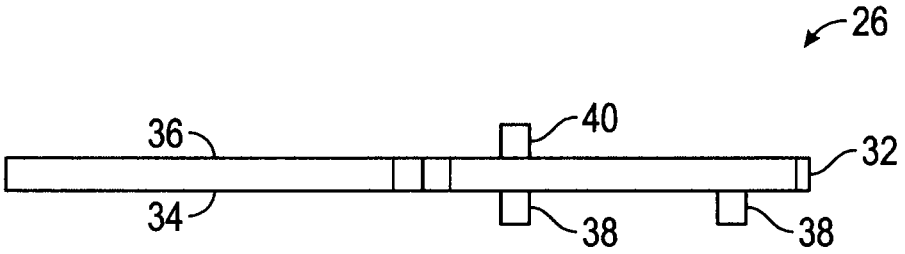
FIG. 4 is a side elevational view of a plate of the buckle assembly of FIG. 3.

FIGS. 2 and 4 illustrate one aspect of the present disclosure in which the tongue 32 has two pins 38 extending from the first side 34. One of the pins 38 may be an extension of the pin 40 extending from the second side 36 of the tongue 32.

The sleeve 30 of the receiver 28 is configured to slideably receive the tongue 32 when the pin 38 of the first side 34 of the tongue 32 is positioned in one of the through-holes 22 of the stirrup strap 12. The sleeve 30 has been shown as encompassing the stirrup strap 12, however, it will be appreciated that the sleeve 30 may be formed in other configurations, such as C shaped, so long as the sleeve 30 remains secured to the stirrup strap 12.

Figure 3:
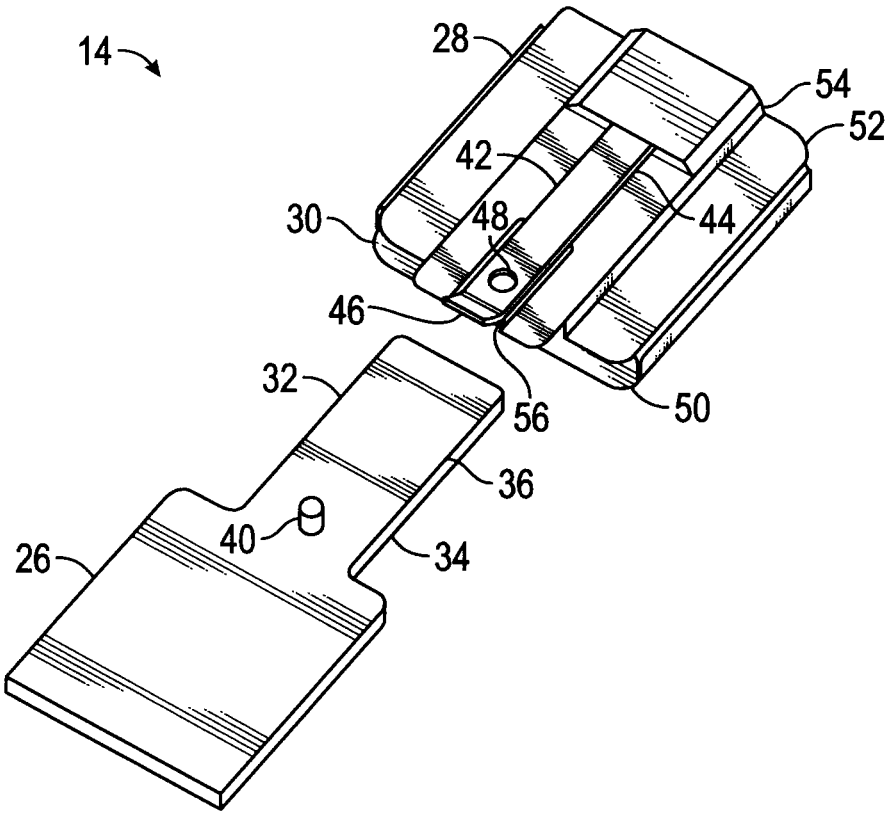
FIG. 3 is a front perspective view of the buckle assembly of FIG. 1.

As shown in FIG. 3, the receiver 28 has a spring latch 42 with a proximal end 44 and a distal end 46. The distal end 46 has an opening 48 for receiving the pin 40 of the second side 36 of the tongue 32. The spring latch 42 may be formed of any suitable durable material, such as spring steel.

Figure 5:
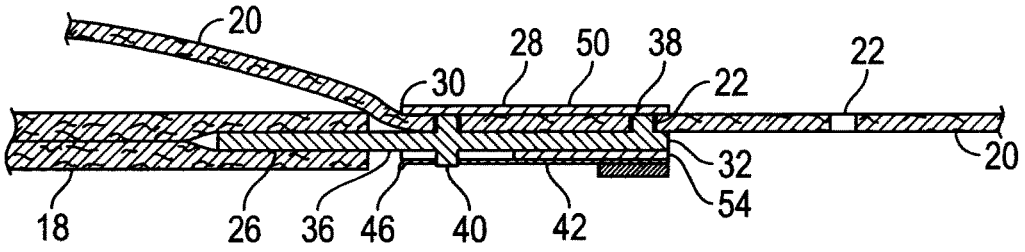
FIG. 5 is a cross-sectional view of the buckle assembly shown attached to the stirrup strap and in a locking position.
Figure 6:
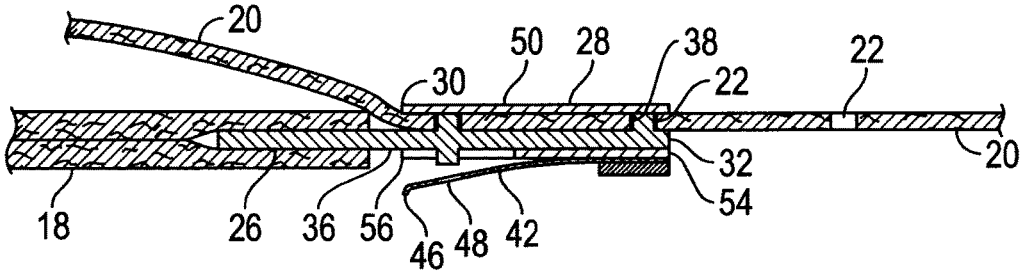
FIG. 6 is a cross-sectional view of the buckle assembly shown attached to the stirrup strap and in the release position.

The spring latch 42 extends from the sleeve 30 in a way that the spring latch 42 is moveable between a locking position (FIG. 5) and a release position (FIG. 6). In the locking position, the distal end 46 of the spring latch 42 is biased to receive the pin 40 of the second side 36 of the tongue 32 in the opening 48 when the pin(s) 38 of the first side 34 is inserted in one of the through-holes 22. In the release position, the distal end 46 of the spring latch 42 is deflected away from the pin 40 of the second side 36 of the tongue 32 so as to permit the receiver 28 to slide relative to the tongue 32.

The spring latch 42 may be attached to the sleeve 30 in any suitable manner, non-exclusive examples of which include spot welding, riveting, pressing, and bending. Alternatively and/or additionally, the spring latch 42 may be formed as a whole with the sleeve 30.

As shown in FIGS. 3, 5, and 6, the sleeve 30 has a first side 50 and a second side 52 with a raised longitudinal channel 54 configured to receive the tongue 32 on the second side 52 of the sleeve 30. In one embodiment, the second side 52 of the sleeve 30 has a guide slot 56 for receiving the pin 40 as the sleeve 30 slideably receives the tongue 32. The spring latch 42 is positioned on the second side 52 of the sleeve 30 so as to extend into the guide slot 56.

Figure 7:
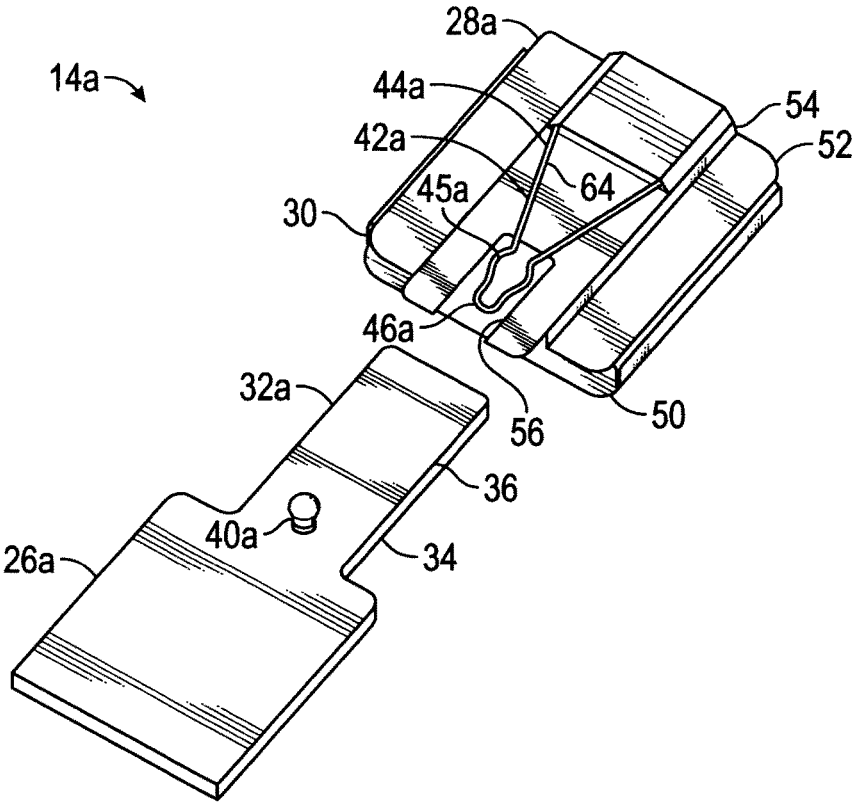
FIG. 7 is a perspective view of another embodiment of a buckle assembly constructed in accordance with the inventive concepts disclosed herein
Figure 8:
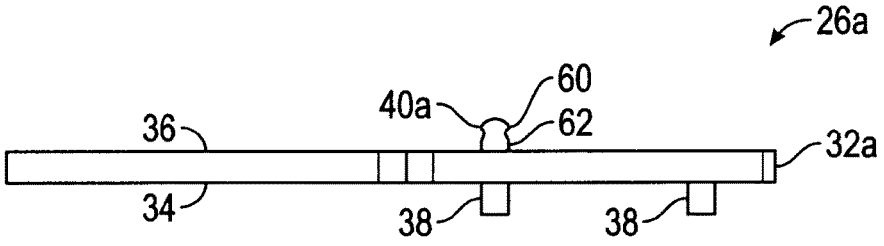
FIG. 8 is a side elevational view of a plate of the buckle assembly of FIG. 7.
Figure 9:
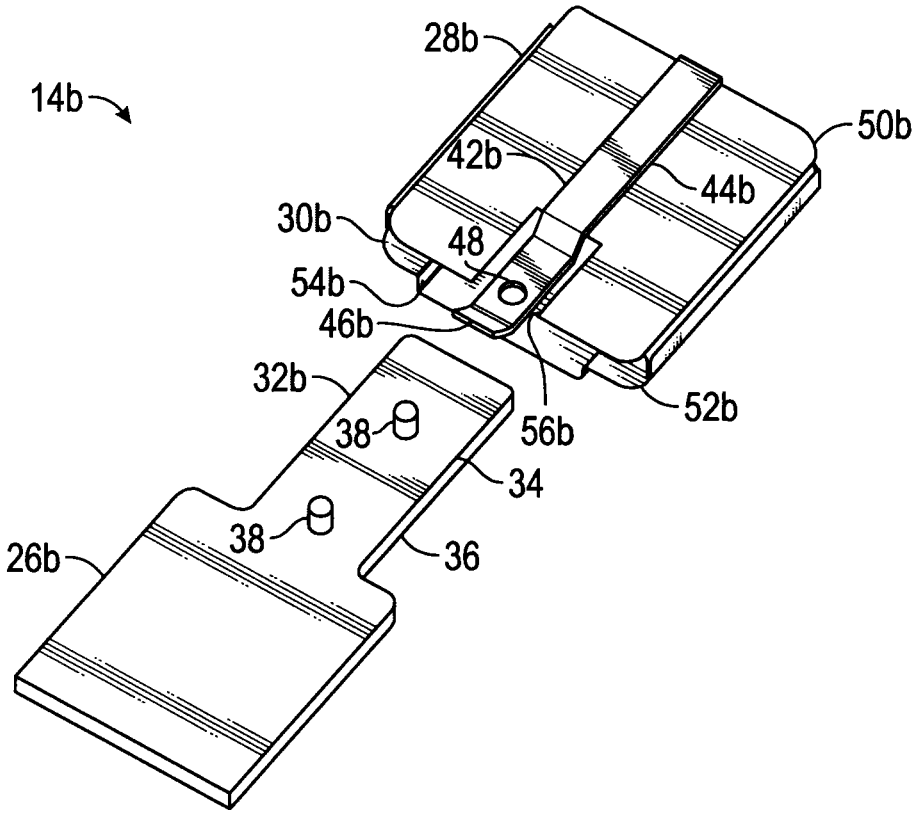
FIG. 9 is a perspective view of another embodiment of a buckle assembly constructed in accordance with the inventive concepts disclosed herein.
Figure 10:
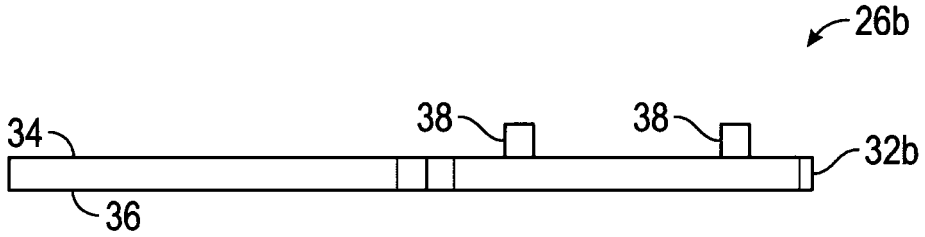
FIG. 10 is a side elevational view of a plate of the buckle assembly of FIG. 9.
Figure 11:
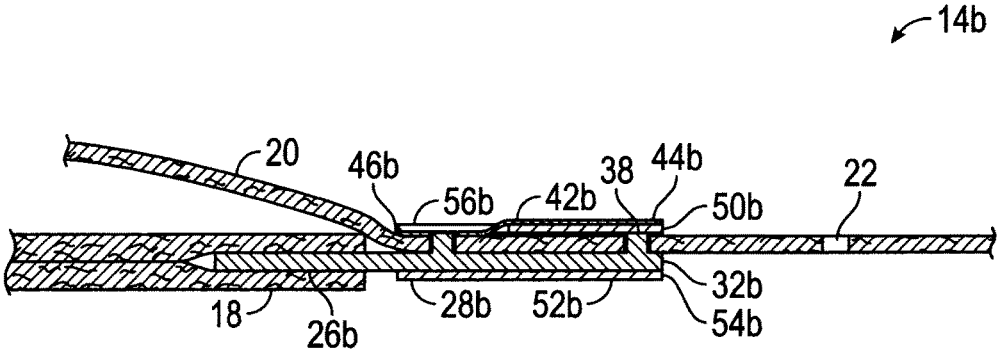
FIG. 11 is a cross-sectional view of the buckle assembly of FIG. 9 shown attached to a stirrup strap and in a locking position.

FIGS. 7 and 8 show another embodiment of a buckle assembly **14*a* constructed in accordance with the inventive concepts disclosed herein. The buckle assembly 14*a* is substantially similar to the buckle assembly 14, except as described herein below. The buckle assembly 14*a* includes a plate 26*a* connectable to the first end 18 of the stirrup strap 12 and a receiver 28*a* having a sleeve 30 configured to slideably receive the second end 20 of the stirrup strap 12. The plate 26*a* has a tongue 32*a* extending from the first end 18 of the stirrup strap 12 when the plate 26*a* is connected to the stirrup strap 12. The tongue 32*a* has a first side 34 and a second side 36. The tongue 32*a* has at least one pin 38 extending substantially perpendicularly from the first side 34 and at least one pin 40*a* extending substantially perpendicularly from the second side 36. The pin 38 of the first side 34 is insertable in a least one of a plurality of through-holes 22 extending through the stirrup strap 12 near the second end 20 of the stirrup strap 12. The pin 40*a* extending from the second side 36 of the tongue 32*a* has a substantially rounded top portion 60 and a neck portion 62 narrower than the rounded top portion 60**.

The receiver **28*a* of buckle assembly 14*a* has a spring latch 42*a* comprised of a flexible wire 64. The spring latch 42*a* has a proximal end 44*a* and a distal end 46*a* with the distal end 46*a* forming an opening 48*a*. The opening 48*a* has a narrower width than the top portion 60 of the pin 40*a* such that the flexible wire 64 forming the opening 48*a* is expandable to allow the opening 48*a* to pass over the top portion 60 to the neck portion 62**.

The spring latch **42*a* extends from the sleeve 30 in a way that the spring latch 42*a* is moveable between a locking position and a release position similar to that described above in reference to the buckle assembly 14. When the sleeve 30 slideably receives the tongue 32, the distal end 46*a* of the spring latch 42*a* receives the top portion 60 then the neck portion 62 of the pin 40*a* in the opening 48*a*, thereby locking the wider top portion 60 in the spring latch 42*a* in the locking position. To reach the release position, the distal end 46***a* of the spring latch 42*a* is deflected away from the pin 40*a* and the opening 48*a* expands to release the pin 40*a* so as to permit the receiver 28 to slide relative to the tongue 32.

FIGS. 9-12 show another embodiment of a buckle assembly 14*b* constructed in accordance with the inventive concepts disclosed herein. The buckle assembly 14*b* is similar to the buckle assembly 14 described above, except as described herein below. The buckle assembly 14*b* includes a plate 26*b* connectable to the first end 18 of the stirrup strap 12 and a receiver 28*b* having a sleeve 30*b* configured to slideably receive the second end 20 of the stirrup strap 12. The plate 26*b* has a tongue 32*b* extending from the first end 18 of the stirrup strap 12 when the plate 26*b* is connected to the stirrup strap 12. The tongue 32*b* has a first side 34 and a second side 36. In the buckle assembly 14*b*, the plate 26*b* has at least one pin 38 extending substantially perpendicularly from a first side 34. The length of the pin 38 may be greater than the thickness of the stirrup strap 12. The pin 38 of the first side 34 is insertable in a least one of the plurality of through-holes 22 extending through the stirrup strap 12 near the second end 20 of the stirrup strap 12. One or more additional pins 38 may extend substantially perpendicularly from the first side 34.

The sleeve 30*b* of the receiver 28*b* is configured to slideably receive the tongue 32*b* when the pins 38 of the first side 34 of the tongue 32*b* are positioned in the through-holes 22 of the stirrup strap 12. The sleeve 30*b* has a first side 50*b* and a second side 52*b* with the second side 52*b* having a channel 54*b* configured to receive the tongue 32*b*. In one embodiment, the first side 50*b* of the sleeve 30*b* is provided with a guide slot 56*b* to receive at least one of the pins 38.

The receiver 28*b* has a spring latch 42*b* with a proximal end 44*b* and a distal end 46*b*. The distal end 46*b* has an opening 48 for receiving the pin 38 extended through the through-hole 22 of the stirrup strap 12. The spring latch 42 is positioned on the first side 50*b* of the sleeve 30*b* with the distal end 46 extending into the guide slot 56*b* to allow the pin 38 to be received into the opening 48 as the sleeve 30*b* slideably receives the tongue 32*b*.

Figure 12:
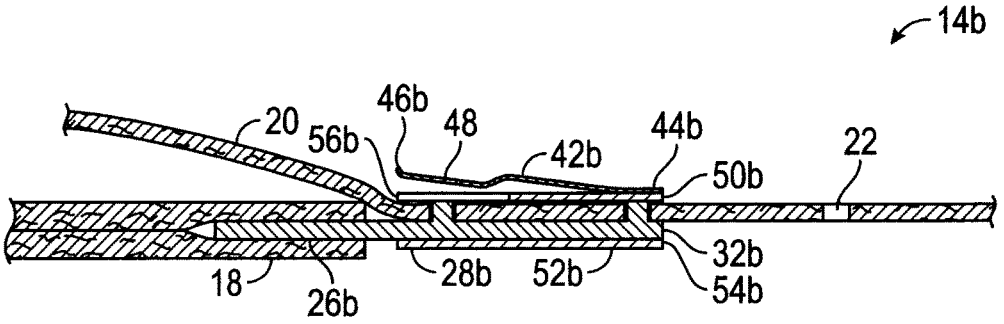
FIG. 12 is a cross-sectional view of the buckle assembly of FIG. 9 shown attached to the stirrup strap and in a release position.
Figure 13:
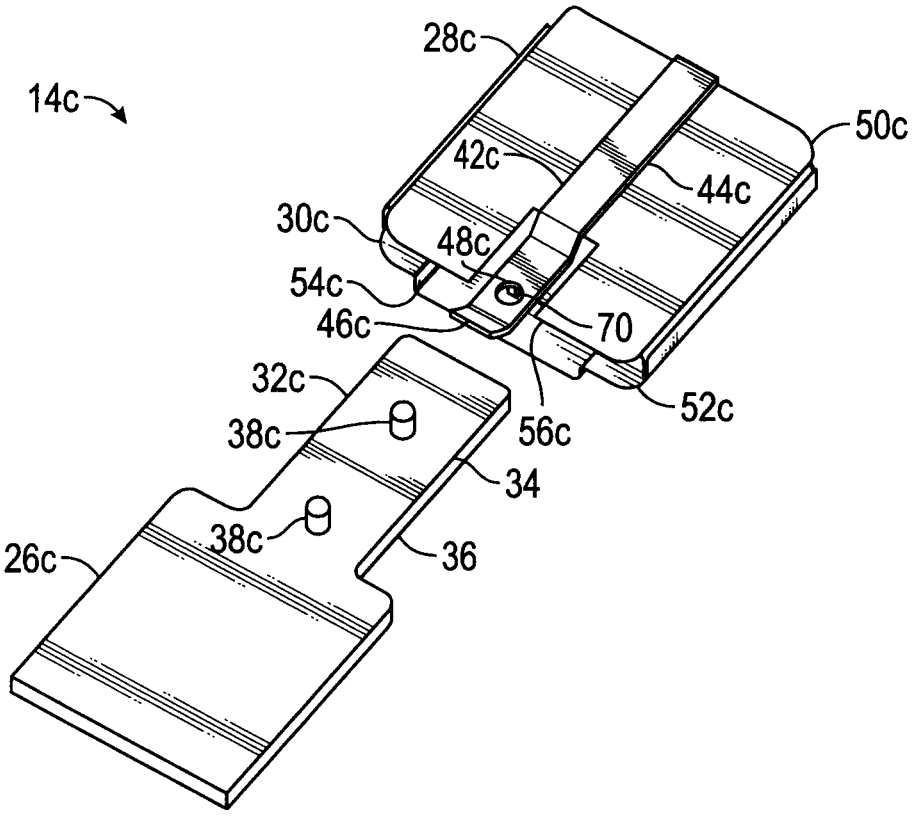
FIG. 13 is a perspective view of another embodiment of a buckle assembly constructed in accordance with the inventive concepts disclosed herein.
Figure 14:
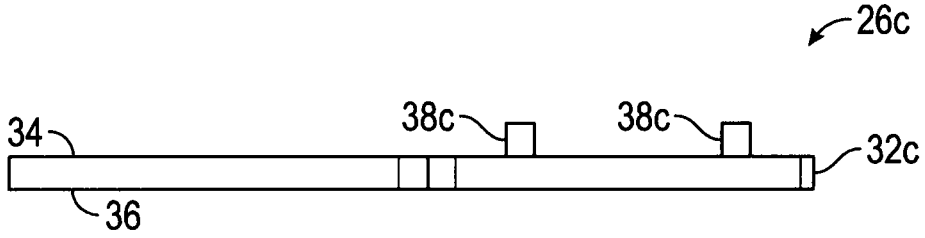
FIG. 14 is a side elevational view of a plate of the buckle assembly of FIG. 13.
Figure 15:
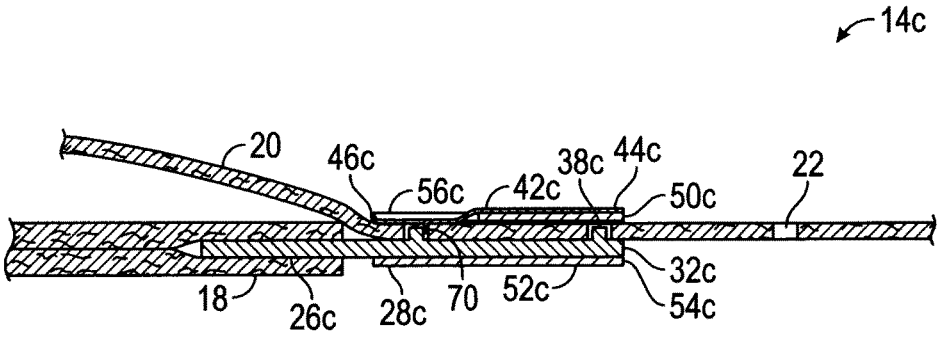
FIG. 15 is a cross-sectional view of the buckle assembly of FIG. 13 shown attached to a stirrup strap and in a locking position.

The spring latch 42*b* extends from the sleeve 30*b* in a way that the spring latch 42*b* is moveable between a locking position (FIG. 11) and a release position (FIG. 12). In the locking position, the distal end 46*b* of the spring latch 42*b* is biased to receive the pin 38 of the first side 34 of the tongue 32*b* in the opening 48 when the pins 38 of the first side 34 are inserted in the through-holes 22. In the release position, the distal end 46*b* of the spring latch 42*b* is deflected away from the pin 38 of the first side 34 of the tongue 32*b* so as to permit the receiver 28*b* to slide relative to the tongue 32*b*.

FIGS. 13-16 show another embodiment of a buckle assembly 14*c* constructed in accordance with the inventive concepts disclosed herein. The buckle assembly 14*c* is similar to the buckle assembly 14*b* described above, except as described herein below. The buckle assembly 14*c* includes a plate 26*c* connectable to the first end 18 of the stirrup strap 12 and a receiver 28*c* having a sleeve 30*c* configured to slideably receive the second end 20 of the stirrup strap 12. The plate 26*c* has a tongue 32*c* extending from the first end 18 of the stirrup strap 12 when the plate 26*c* is connected to the stirrup strap 12. The tongue 32*c* has a first side 34 and a second side 36. In the buckle assembly 14*c*, the plate 26*c* has at least one pin 38*c* extending substantially perpendicularly from a first side 34. The length of the pin 38*c* may be less than the thickness of the stirrup strap 12. The pin 38*c* of the first side 34 is insertable in a least one of the plurality of through-holes 22 extending through the stirrup strap 12 near the second end 20 of the stirrup strap 12. One or more additional pins 38*c* may extend substantially perpendicularly from the first side 34.

The sleeve 30*c* of the receiver 28*c* is configured to slideably receive the tongue 32*c* when the pins 38*c* of the first side 34 of the tongue 32*c* are positioned in the through-holes 22 of the stirrup strap 12. The sleeve 30*c* has a first side 50*c* and a second side 52*c* with the second side 52*c* having a channel 54*c* configured to receive the tongue 32*c*. In one embodiment, the first side 50*c* of the sleeve 30*c* is provided with a guide slot 56*c* to receive at least one of the pins 38*c*.

The receiver 28*c* has a spring latch 42*c* with a proximal end 44*c* and a distal end 46*c*. The distal end 46*c* may have an opening 48*c*. The distal end 46*c* has a barb 70 extending outward from the spring latch 42*c*. The spring latch 42*c* is positioned on the first side 50*c* of the sleeve 30*c* with the distal end 46*c* extending into the guide slot 56*c* to allow the barb 70 to fit between the pin 38*c* and a side of the through-hole 22 when the sleeve 30*c* slideably receives the tongue 32*c*. The barb 70 may extend substantially perpendicularly from the spring latch 42*c*, though it will be understood that the barb 70 may extend at an angle from the spring latch 42*c*, as long as the barb 70 is positionable between the pin 38*c* and a side of the through-hole 22. In embodiments with the opening 48*c*, the barb 70 may be positioned proximate to the opening 48*c*. In one embodiment, the spring latch 42*c* may not be provided with an opening and may include only the barb 70. The length of the spring latch 42*c* may be varied so long as the barb 70 may be positioned in a location between the pin 38*c* and the side of the through-hole 22. For example, in one embodiment the barb 70 may be positioned between the pin 38*c* and the through-hole on the opposite side of the pin 38*c* of that shown in FIG. 15.

The diameter of the pin 38*c* has been shown reduced relative to the diameter of the through-hole 22 for purposes of illustrating the barb 70 positioned between the pin 38*c* and the side of the through-hole 22. It will be understood that the diameter of the pin 38*c* and the diameter of the through-hole 22 may be substantially equal and that the barb 70 is configured to slide between the pin 38*c* and the side of the through-hole 22.

Figure 16:
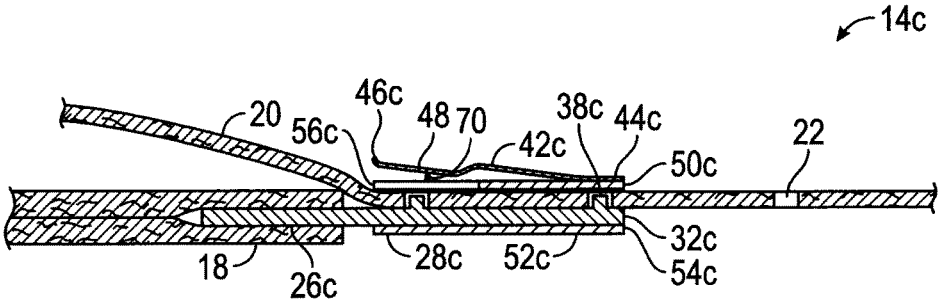
FIG. 16 is a cross-sectional view of the buckle assembly of FIG. 13 shown attached to the stirrup strap and in a release position.

The spring latch 42*c* extends from the sleeve 30*c* in a way that the spring latch 42*c* is moveable between a locking position (FIG. 15) and a release position (FIG. 16). In the locking position, the distal end 46*c* of the spring latch 42*c* is biased such that the barb 70 is positioned in the through-hole 22 between the pin 38*c* and the side of the through-hole 22 when the pins 38 are inserted in the through-holes 22. In the release position, the barb 70 and the spring latch 42*c* are deflected away from the pin 38*c* and the through-hole 22 so as to permit the receiver 28*c* to slide relative to the tongue 32*c*.

It will be appreciated that the spring latch 42, 42*a*, 42*b*, 42*c* may be formed in a variety of ways, including but not limited to those shown in the figures herein. For example, the spring latch 42, 42*a*, 42*b*, 42*c* may be straight or may be bent to conform to the stirrup strap 12 or tongue 32 to facilitate engagement with pin 38 or 40.

The sleeve 30, 30*b*, 30*c* may be encompassed partially, or completely, with one or more materials (not shown). The material may protect the stirrup strap 12, the saddle 10, the horse, and/or the rider, from rubbing by the sleeve 30. Additionally, or alternatively, the material may be decorative. Non-exclusive exemplary materials include leather, neoprene, plastic, and rubber. The material may be the same material as the stirrup strap 12. The material may be attached to the sleeve 30, 30*b*, 30*c* by any suitable mechanism, including rivets and/or glue. Additionally, or alternately, the sleeve 30, 30*b*, 30*c* may be dipped or sprayed with the material.

The distal end 46, 46*a*, 46*b*, 46*c* of the spring latch 42, 42*a*, 42*b*, 42*c* may be coated with one or more protective material (not shown), non-exclusive examples of which include plastic and/or rubber.

Referring now to FIGS. 1-6, the method of securing the stirrup strap 12 using the buckle assembly 14 to a desired length will be described. A rider may deflect the spring latch 42 away from the pin 40 to the release position to permit the receiver 28 to slide relative to the tongue 32 (FIG. 6). The pin(s) 38 inserted in the through-holes 22 of the stirrup strap 12 may then be removed from the through-holes 22. The plate 26 may then be freely moved to different through-holes 22 on the second end 20 of the stirrup strap 12, thus shortening or lengthening the length of the stirrup strap 12.

Once the desired length is achieved, the pin(s) 38 are inserted into the desired through-holes 22. The receiver 28 is slideably moved along the stirrup strap 12 to engage the tongue 32. The distal end 46 of the spring latch 42 is deflected from the biased position to move over the pin 40 (FIG. 6) until the pin 40 is engaged in the opening 48 and the spring latch 42 returns to the locking position (FIG. 5).

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and claimed herein. For example, the through-holes 22 and the receiver 28 may be on the first end 18 of the stirrup strap 12 while the plate 26 may be on the second end 20 of the stirrup strap 12.

Additionally, while the buckle assembly 14 has been described in the context of a western style saddle stirrup strap 12, it will be understood the buckle assembly 14 may be used in conjunction with any strap requiring locking adjustment.

What is claimed is:

1. A buckle assembly for a stirrup strap, comprising:

a plate connectable to a first end of the stirrup strap, the plate having a tongue extendable from the first end of the stirrup strap when the plate is connected to the stirrup strap, the tongue having a first side and a second side opposing the first side, with at least one pin having a first end extending perpendicularly from the first side and having a second end extending perpendicularly from the second side, the first end of the pin being insertable in at least one of a plurality of through-holes extending through the stirrup strap near a second end thereof; and a receiver having a sleeve with a first side and a second side, the sleeve being configured to slideably receive the second end of the stirrup strap and the tongue when the first end of the pin is positioned in one of the through-holes of the stirrup strap, the receiver further having a spring latch with a proximal end and a distal end, the distal end having an opening for receiving the second end of the pin, the spring latch extending from the sleeve in a way that the spring latch is moveable between a locking position wherein the distal end of the spring latch is biased to receive the second end of the pin when the first end of the pin is inserted in one of the through-holes and a release position wherein the distal end is deflected away from the second end of the pin so as to permit the receiver to slide relative to the tongue.

2. The buckle assembly of claim 1, wherein the second side of the sleeve has a raised longitudinal channel configured to receive the tongue.

3. The buckle assembly of claim 1, wherein the second side of the sleeve has a guide slot for receiving the at least one pin extending perpendicularly from the second side.

4. A stirrup strap, comprising:

a strap having a first end and a second end, the second end having a plurality of through-holes; and a buckle assembly, comprising:

a plate connected to the first end of the strap, the plate having a tongue extending from the first end of the strap, the tongue having a first side and a second side opposing the first side, with at least one pin having a first end extending perpendicularly from the first side and having a second end extending perpendicularly from the second side, the first end of the pin being insertable in at least one of a plurality of through-holes extending through the strap; and a receiver having a sleeve with a first side and a second side, the sleeve being configured to slideably receive the second end of the strap and the tongue when the first end of the pin is positioned in one of the through-holes of the strap, the receiver further having a spring latch with a proximal end and a distal end, the distal end having an opening for receiving the second end of the pin, the spring latch extending from the sleeve in a way that the spring latch is moveable between a locking position wherein the distal end of the spring latch is biased to receive the second end of the pin when the first end of the pin is inserted in one of the through-holes and a release position wherein the distal end is deflected away from the second end of the pin so as to permit the receiver to slide relative to the tongue.

5. A buckle assembly for a stirrup strap, comprising:

a plate connectable to a first end of the stirrup strap, the plate having a tongue extendable from the first end of the stirrup strap when the plate is connected to the stirrup strap, the tongue having a first side and a second side opposing the first side, with at least one pin extending perpendicularly from the first side, the pin being insertable in at least one of a plurality of through-holes extending through the stirrup strap near a second end thereof; and a receiver having a sleeve with a first side and a second side, the sleeve being configured to slidably receive the second end of the stirrup strap and the tongue when the pin of the first side of the tongue is positioned in one of the through-holes of the stirrup strap, the receiver further having a spring latch with a proximal end and a distal end, the distal end having a barb extending perpendicularly from the spring latch, the spring latch extending from the sleeve in a way that the spring latch is moveable between a locking position wherein the distal end of the spring latch is biased to position the barb between the pin and a side of the through-hole when the pin is inserted in one of the through-holes and a release position wherein the distal end and barb are deflected away from the pin to permit the receiver to slide relative to the tongue.

6. A stirrup strap, comprising:

a strap having a first end and a second end, the second end having a plurality of through-holes; and a buckle assembly, comprising:

a plate connected to the first end of the strap, the plate having a tongue extending from the first end of the strap, the tongue having a first side and a second side opposing the first side, with at least one pin extending perpendicularly from the first side, the pin being insertable in at least one of a plurality of through-holes of the strap; and a receiver having a sleeve with a first side and a second side, the sleeve being configured to slideably receive the second end of the strap and the tongue when the pin of the first side of the tongue is positioned in one of the through-holes of the strap, the receiver further having a spring latch with a proximal end and a distal end, the distal end having a barb extending perpendicularly from the spring latch, the spring latch extending from the sleeve in a way that the spring latch is moveable between a locking position wherein the distal end of the spring latch is biased to position the barb between the pin and a side of the through-hole when the pin is inserted in one of the through-holes and a release position wherein the distal end and barb are deflected away from the pin to permit the receiver to slide relative to the tongue.

7. A buckle for a stirrup strap, the stirrup strap having a plate connected to a first end of the stirrup strap, the plate having a tongue extending from the first end of the stirrup strap, the tongue having a first side and a second side opposing the first side, with at least one pin extending perpendicularly from the first side, the pin being insertable in at least one of a plurality of through-holes extending through the stirrup strap near a second end thereof, the buckle comprising:

a sleeve with a first side and a second side, the sleeve being configured to slidably receive the second end of the stirrup strap and the tongue of the plate when the pin of the first side of the tongue is positioned in one of the through-holes of the stirrup strap, and a spring latch having a proximal end and a distal end, the spring latch extending from the sleeve in a way that the spring latch is moveable between a locking position wherein the distal end of the spring latch is biased to engage the stirrup strap and a release position wherein the distal end is deflected away from the stirrup strap to permit the sleeve to slide relative to the tongue;

wherein the distal end of the spring latch has a barb extending perpendicularly from the spring latch such that in the locking position the barb is positionable between the pin of the first side of the tongue and a side of the through-hole of the stirrup strap when the pin is inserted in one of the through-holes and in the release position the distal end and barb are deflected away from the pin to permit the sleeve to slide relative to the tongue.

8. The buckle of claim 7, wherein the distal end of the spring latch of the sleeve has an opening for receiving the pin of the first side of the tongue, such that in the locking position the opening of the distal end of the spring latch is biased to receive the pin of the first side of the tongue when the pin of the first side is inserted in one of the through-holes and in the release position the opening of the distal end is deflected away from the pin of the first side so as to permit the sleeve to slide relative to the tongue.

9. The buckle of claim 7, wherein the stirrup strap has a thickness and the pin has a length less than the thickness of the stirrup strap.

10. The buckle of claim 7, wherein the at least one pin extending perpendicularly from the first side of the tongue is two pins substantially aligned along a length of the tongue, the two pins being insertable in at least two of the plurality of through-holes extending through the stirrup strap near the second end thereof, wherein the barb extending perpendicularly from the distal end of the spring latch is positionable between one of the two pins and a side of the through-hole of the stirrup strap when the two pins are inserted in two of the through-holes.

11. The buckle of claim 7, wherein the sleeve is encompassed by a material chosen from the group consisting of leather, neoprene, plastic, and rubber.

12. The buckle of claim 7, wherein the second side of the sleeve has a channel configured to receive the tongue.

13. The buckle of claim 7, wherein the first side of the sleeve has a guide slot aligned to receive the at least one pin.

* * * * *